US008067137B2

(12) United States Patent
Wu

(10) Patent No.: US 8,067,137 B2
(45) Date of Patent: Nov. 29, 2011

(54) POLYMER CONTAINING CHARGE TRANSPORT PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 766 days.

(21) Appl. No.: 12/164,457

(22) Filed: Jun. 30, 2008

(65) Prior Publication Data

US 2009/0325089 A1 Dec. 31, 2009

(51) Int. Cl.
*G03G 5/047* (2006.01)

(52) U.S. Cl. ..... 430/58.2; 430/58.05; 430/58.75; 430/58.8; 430/59.4; 430/59.6

(58) Field of Classification Search ..... 430/58.05, 430/58.2, 58.75, 58.8, 59.4, 59.6
See application file for complete search history.

(56) References Cited

U.S. PATENT DOCUMENTS

| | | | | |
|---|---|---|---|---|
| 4,265,990 | A | 5/1981 | Stolka et al. | |
| 4,587,189 | A | 5/1986 | Hor et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 2008/0057426 | A1 * | 3/2008 | McGuire et al. | 430/58.8 |
| 2008/0107985 | A1 | 5/2008 | Yanus et al. | |
| 2009/0325090 | A1 | 12/2009 | Wu et al. | |
| 2009/0325092 | A1 | 12/2009 | Wu | |
| 2009/0325093 | A1 | 12/2009 | Wu | |
| 2009/0325095 | A1 | 12/2009 | Wu | |
| 2009/0325096 | A1 | 12/2009 | Wu et al. | |

OTHER PUBLICATIONS

Jin Wu et al., U.S. Appl. No. 12/033,267, filed Feb. 19, 2008, entitled Overcoat Containing Fluorinated Poly(Oxetane) Photoconductors.
Jin Wu et al., U.S. Appl. No. 12/033,279, filed Feb. 19, 2008, entitled Backing Layer Containing Photoconductor.
Jin Wu, U.S. Appl. No. 12/129,989, filed May 30, 2008, entitled Polymer Anticurl Backside Coating (ACBC) Photoconductors.

* cited by examiner

*Primary Examiner* — Peter Vajda
(74) *Attorney, Agent, or Firm* — Oliff & Berridge, PLC

(57) ABSTRACT

A photoconductor that includes a supporting substrate, a photogenerating layer, and at least one charge transport layer that contains at least one charge transport component, and a polysiloxane/polyetherimide polymer.

29 Claims, No Drawings

POLYMER CONTAINING CHARGE TRANSPORT PHOTOCONDUCTORS

CROSS REFERENCES TO RELATED APPLICATIONS

U.S. application Ser. No. 12/164,338, now U.S. Publication No. 20090325090 on Phenolic Resin Hole Blocking Layer Photoconductors, filed Jun. 30, 2008, the disclosure of which is totally incorporated herein by reference.

Copending U.S. application Ser. No. 12/164,549, U.S. Publication No. 20090325096 on Tris(enylaryl)amine Containing Photoconductors, filed Jun. 30, 2008, the disclosure of which is totally incorporated herein by reference.

Copending U.S. application Ser. No. 12/164,596, U.S. Publication No. 20090325092 on Tris(enylaryl)arylamine Containing Photoconductors, filed Jun. 30, 2008, the disclosure of which is totally incorporated herein by reference.

Copending U.S. application Ser. No. 12/164,658, U.S. Publication No. 20090325095 on Tris and Bis(enylaryl)arylamine Mixtures Containing Photoconductors, filed Jun. 30, 2008, the disclosure of which is totally incorporated herein by reference.

Copending U.S. application Ser. No. 12/164,701, U.S. Publication No. 20090325093 on (Enylaryl)bisarylamine Containing Photoconductors, filed Jun. 30, 2008, the disclosure of which is totally incorporated herein by reference.

There is disclosed in U.S. application Ser. No. 11/593,875, U.S. Publication No. 20080107985, now U.S. Pat. No. 7,799,497, filed Nov. 7, 2006, entitled Silanol Containing Overcoated Photoconductors, an imaging member comprising an optional supporting substrate, a silanol containing photogenerating layer, and at least one charge transport layer comprised of at least one charge transport component and an overcoating layer in contact with and contiguous to the charge transport, and which overcoating is comprised of an acrylated polyol, a polyalkylene glycol, a crosslinking agent, and a charge transport component U.S. application Ser. No. 12/033,267, now U.S. Pat. No. 7,776,499, filed Feb. 19, 2008, entitled Overcoat Containing Fluorinated Poly(Oxetane) Photoconductors, the disclosure of which is totally incorporated herein by reference, discloses a photoconductor comprising a supporting substrate, a photogenerating layer, and at least one charge transport layer comprised of at least one charge transport component, and in contact with the charge transport layer an overcoat layer comprised of a polymer, an optional charge transport component, and a fluorinated poly(oxetane) polymer.

U.S. application Ser. No. 12/033,279, now U.S. Pat. No. 7,781,133, filed Feb. 19, 2008, entitled Backing Layer Containing Photoconductor, the disclosure of which is totally incorporated herein by reference, a photoconductor comprising a substrate, an imaging layer thereon, and a backing layer located on a side of the substrate opposite the imaging layer wherein the outermost layer of the backing layer adjacent to the substrate is comprised of a self crosslinked acrylic resin and a crosslinkable siloxane component.

U.S. application Ser. No. 12/129,989, now U.S. Pat. No. 7,951,514, filed May 30, 2008, entitled Polymer Anticurl Backside Coating (ACBC) Photoconductors, the disclosure of which is totally incorporated herein by reference, a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a polysiloxane/polyetherimide copolymer.

The appropriate components and processes, number and sequence of the layers, component and component amounts in each layer, and the thicknesses of each layer of the above copending applications, may be selected for the present disclosure photoconductors in embodiments thereof.

BACKGROUND

This disclosure is generally directed to photoreceptors, photoconductors, and the like. More specifically, the present disclosure is directed to multilayered drum, or flexible, belt imaging members, or devices comprised of a first layer, a supporting medium like a substrate, a photogenerating layer, and a charge transport layer (CTL), including a plurality of CTLs, such as a first CTL and a second CTL, an optional adhesive layer, an optional hole blocking or undercoat layer, and an optional overcoat layer. More specifically, the photoconductors disclosed contain a CTL comprised of a polysiloxane-b-polyetherimide block copolymer.

The CTL of the present disclosure possesses a desirable low surface energy, thus the wear resistance of this layer is excellent and is comparable to a CTL containing a polytetrafluoroethylene (PTFE). Moreover, the CTL of the present disclosure contains an environmentally non-hazardous polymer as compared, for example, to PTFE; the coating solution containing the polysiloxane/polyetherimide copolymer is stable for extended time periods; minimal agglomeration of the CTL layer components result thereby increasing the slipperiness of this layer as compared to a CTL with micron-sized particles of PTFE; the use of molecularly dispersed (soluble) or micro phase separated (nano-sized domains) additives of a polysiloxane/polyetherimide copolymer, such as a polysiloxane-b-polyetherimide copolymer, that substantially avoid the escape of the polymer particles when the CTL is worn down that adversely impact the systems in which the CTL layer is present; and other advantages as illustrated herein for photoconductors with charge transport layers comprising a polysiloxane/polyetherimide copolymer.

The CTL layer, which can be solution coated, for example, on the photogenerating layer may comprise a number of suitable polysiloxane-b-polyetherimide materials such as those components that substantially reduce surface contact friction and prevent or minimize wear/scratch problems for the photoreceptor device. In embodiments, the mechanically robust CTL layer of the present disclosure usually will not substantially reduce the layer's thickness over extended time periods to thereby adversely affect its hole transport characteristics causing print defects which prevent the imaging process from continuously allowing a satisfactory quality copy or printout quality; and moreover, CTL wear also produces dirt and debris resulting in dusty machine operation condition.

The CTL layers illustrated herein, in embodiments, have excellent wear resistance, extended lifetimes, and permit the elimination or minimization of photoconductive imaging member belt CTL scratches.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635;

4,298,697 and 4,338,390, the disclosures of which are totally incorporated herein by reference, subsequently transferring the toner image to a suitable image receiving substrate, and permanently affixing the image thereto. In those environments wherein the device is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

Layered photoconductive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, such as the supporting substrates, the photogenerating layer components, the CTL components, the overcoating layer components, and the like, of the above-recited patents may be selected for the photoconductors of the present disclosure in embodiments thereof.

SUMMARY

Disclosed are improved imaging members containing a mechanically robust CTL that possesses many of the advantages illustrated herein, such as extended lifetimes of the CTL containing photoconductor such as, for example, in excess, it is believed, of about 1,000,000 simulated imaging cycles, and which photoconductors are believed to exhibit CTL wear and scratch resistance characteristics.

Disclosed are improved imaging members containing a low surface energy CTL that reduces friction.

Additionally illustrated herein are improved flexible belt imaging members comprising the disclosed CTL, and with optional hole blocking layers comprised of, for example, aminosilanes, metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

EMBODIMENTS

Aspects of the present disclosure relate to a photoconductor comprising a flexible supporting substrate, a photogenerating layer, and at least one CTL comprised of at least one charge transport component, and which CTL layer or layers are comprised of charge transport component, a polymer binder, and a polysiloxane/polyetherimide copolymer; a flexible photoconductive imaging member comprised in sequence of a supporting substrate, a photogenerating layer thereover, a CTL, and a protective top overcoat layer; and a photoconductor which includes a hole blocking layer and an adhesive layer where the adhesive layer is situated between the hole blocking layer and the photogenerating layer, and the hole blocking layer is situated between the substrate and the adhesive layer; a photoconductor comprising a supporting substrate, a photogenerating layer, and at least one charge transport layer comprised of at least one charge transport component, and wherein the charge transport layer includes a polysiloxane/polyetherimide copolymer; a photoconductor comprised in sequence of a supporting substrate, a photogenerating layer thereover, and an additive containing charge transport layer, and wherein the additive is a polysiloxane-b-polyetherimide block copolymer; and a photoconductor comprised in sequence of a supporting substrate, a photogenerating layer thereover, and a hole transport layer, and wherein the hole transport layer is comprised of at least one hole transport compound, a binder resin, and a polysiloxane-b-polyetherimide block copolymer.

The CTL with, for example, a thickness of from about 10 to about 125, from about 20 to about 70, or from about 25 to about 50 microns comprises a polysiloxane/polyetherimide copolymer, especially a block copolymer thereof, present in various suitable amounts, such as from about 0.01 to about 30, from about 0.1 to about 20, from 1 to about 15, and from 1 to about 7 weight percent, and where in embodiments it is believed that the polysiloxane functions to primarily impart low surface energy to the CTL layer, and the polyetherimide is believed to act primarily as providing compatibility with a polycarbonate containing CTL layer and a high $T_g$ of from about 150 to about 250° C.

POLYSILOXANE/POLYETHERIMIDE EXAMPLES

Examples of polysiloxane/polyetherimide copolymers, inclusive of block copolymers thereof, present in various effective amounts, such as for example from about 0.1 to about 30, from about 1 to about 15, from about 1 to about 10, from about 2 to about 7, and from about 2 to about 8 weight percent, are polysiloxane-b-polyetherimide block copolymers. Specific examples of the polysiloxane-b-polyetherimide include polysiloxane-b-polyetherimide block copolymer (available as ULTEM® STM1500 from SABIC Innovative Plastics); ULTEM® STM1500 ($T_g$=168° C.); ULTEM® STM1600 ($T_g$=195° C.); and ULTEM® STM1700 ($T_g$=200° C.), all commercially available from Sabic Innovative Plastics.

The weight average molecular weight ($M_w$) of the polysiloxane/polyetherimide copolymer is, for example, from about 5,000 to about 1,000,000, from about 20,000 to about 500,000, from about 50,000 to about 300,000, and from about 75,000 to about 175,000, and the like, wherein the weight percent of the polysiloxane block in the block copolymer is, for example, from about 5 to about 95, from about 10 to about 75, from about 15 to about 50, from about 20 to about 40, and other suitable percentages, and wherein the total of the components in the copolymer is about 100 percent. For the disclosed block copolymer, the polysiloxane block primarily imparts low surface energy to the CTL, while the polyetherimide block primarily permits compatibility with the CTL resin binder, such as a polycarbonate and high $T_g$.

The polysiloxane/polyetherimide polymers and copolymers are available and can be prepared, for example, by reacting 2,2-bis(2,3-dicarboxyphenoxyphenol)propane dianhydride with metaphenyldiamine and an aminopropyl-terminated $D_{10}$ polydimethylsiloxane.

Photoconductive Layer Components

There can be selected for the photoconductors disclosed herein a number of known layers, such as substrates, photogenerating layers, CTLs, hole blocking layers, adhesive layers, protective overcoat layers, and the like. Examples, thicknesses, and specific components of many of these layers include the following.

A number of known supporting substrates can be selected for the photoconductors illustrated herein, such as those substrates that will permit the layers thereover to be effective. The thickness of the photoconductor substrate layer depends on many factors, including economical considerations, electrical characteristics, adequate flexibility, and the like, thus this layer may be of a substantial thickness, for example over 3,000 microns, such as from about 1,000 to about 2,000 microns, from about 500 to about 1,000 microns, or from about 300 to about 700 microns, ("about" throughout includes all values in between the values recited), or of a minimum thickness. In embodiments, the thickness of this layer is from about 75 microns to about 300 microns, or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as, for example, polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the CTL, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations.

The photogenerating composition or pigment is present in the resinous binder composition in various amounts. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon, and compounds of silicon and germanium, carbon, oxygen, nitrogen and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the CTL, and the like. A charge blocking layer or hole blocking layer may optionally be applied to the electrically conductive surface prior to the application of a photogenerating layer. When desired, an adhesive layer may be included between the charge blocking, or hole blocking layer, or interfacial layer and the photogenerating layer. Usually, the photogenerating layer is applied onto the blocking layer and a CTL or plurality of CTLs are formed on the photogenerating layer. This structure may have the photogenerating layer on top of or below the CTL.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 (500 Angstroms) to about 0.3 micron (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like.

As an adhesive layer usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant, followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol, and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the CTL, which layer generally is of a thickness of from about 5 to about 75 microns, and more specifically, of a thickness of from about 10 to about 40 microns. Examples of charge transport components are aryl amines of the following formulas/structures

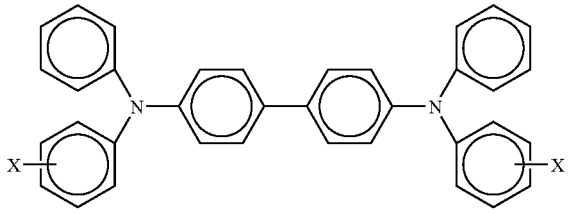

and

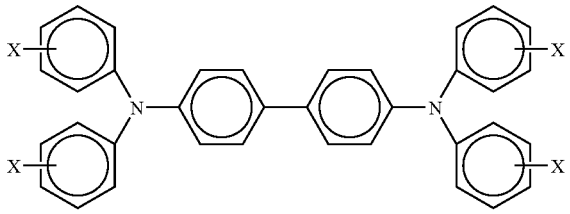

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas/structures

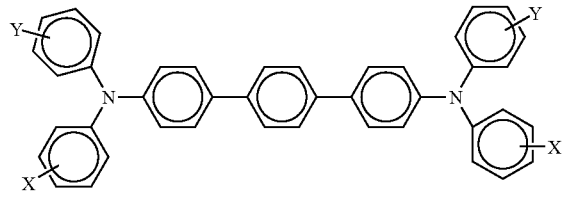

and

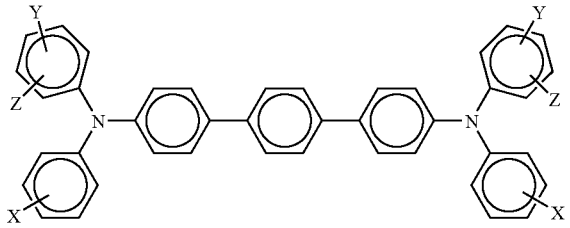

wherein X, Y and Z are independently alkyl, alkoxy, aryl, a halogen, or mixtures thereof; and wherein at least one of Y and Z are present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known CTL molecules can be selected, reference, for example, U.S. Pat. Nos. 4,921,773 and 4,464,450, the disclosures of which are totally incorporated herein by reference.

In embodiments, the charge transport component can be represented by the following formulas/structures, or mixtures thereof

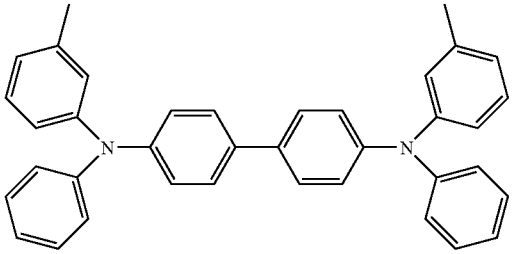

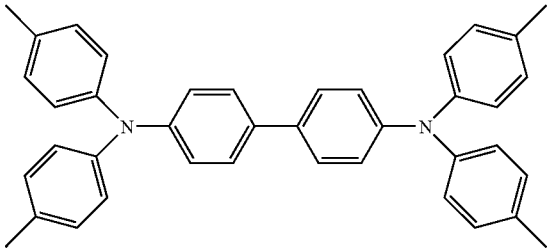

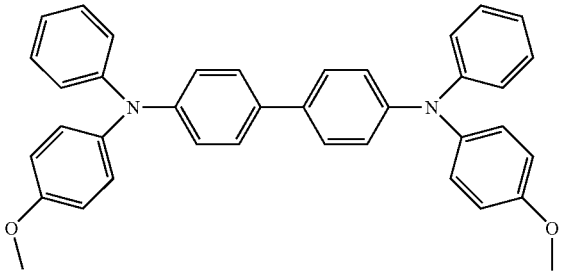

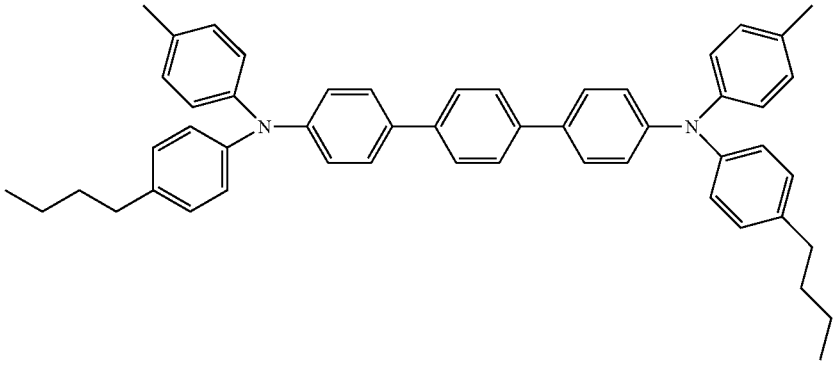

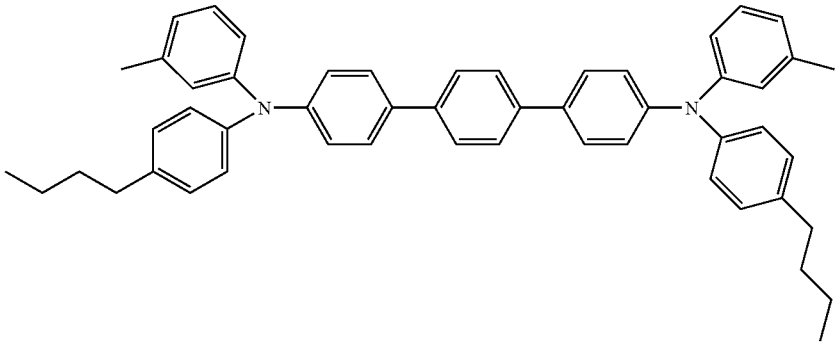

and

-continued

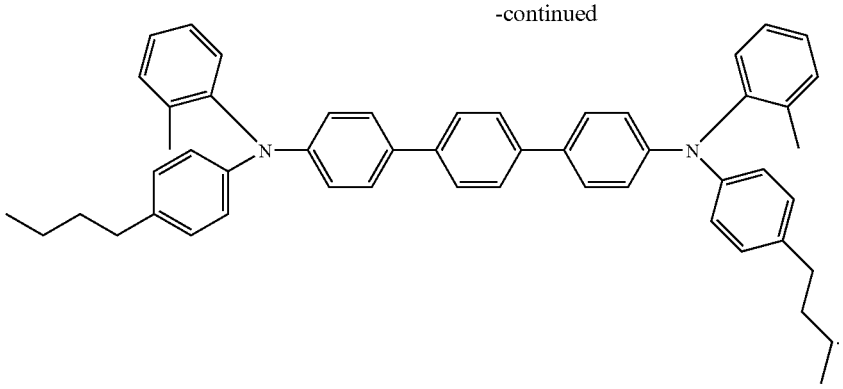

Examples of the binder materials selected for the CTLs include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene) carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The CTL or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the CTL or layers. In embodiments, "charge transport" refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl) carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the CTL should be substantially free (less than about two percent) of di or triamino-triphenyl methane. A small molecule charge transporting compound that permits injection of holes into the photogenerating layer with high efficiency and transports them across the CTL with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the CTL may comprise a polymeric charge transport material or a combination of a small molecule charge transport material and a polymeric charge transport material.

Examples of components or materials optionally incorporated into the CTLs or at least one CTL to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ PS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the CTLs is from about 0 to about 20, from about 1 to about 10, or from about 3 to about 8 weight percent.

A number of processes may be used to mix and thereafter apply the CTL or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the CTL in embodiments is from about 10 to about 70 microns, but thicknesses outside this range may, in embodiments, also be selected. The CTL should be an insulator to the extent that an electrostatic charge placed on the hole transport layer is not conducted in the absence of illumination at a rate sufficient to prevent formation and retention of an electrostatic latent image thereon. In general, the ratio of the thickness of the CTL to the photogenerating layer can be from about 2:1 to 200:1, and in some instances 400:1. The CTL is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional top overcoating layer, such as the overcoating of copending U.S. application Ser. No. 11/593,875, U.S. Publication No. 20080107985, now U.S. Pat. No. 7,799,497, the disclosure of which is totally incorporated herein by reference, may be applied over the CTL to provide abrasion protection.

Aspects of the present disclosure relate to a photoconductive imaging member comprised of a first layer, a supporting substrate, a photogenerating layer, a CTL, and an overcoating CTL; a photoconductive member with a photogenerating layer of a thickness of from about 0.1 to about 10 microns, and at least one transport layer, each of a thickness of from about 5 to about 100 microns; an imaging method and an imaging apparatus containing a charging component, a development component, a transfer component, and a fixing component, and wherein the apparatus contains a photoconductive imaging member comprised of a supporting substrate, and thereover a layer comprised of a photogenerating pigment and a CTL or layers, and thereover an overcoating CTL, and where the transport layer is of a thickness of from about 10 to about 75 microns; a member wherein the photogenerating layer contains a photogenerating pigment present in an amount of from about 5 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the CTLs comprises

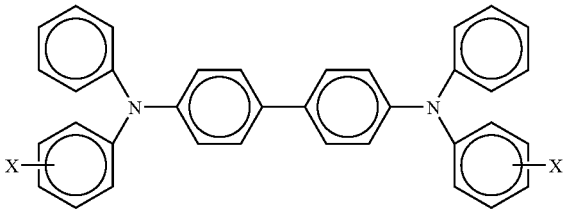

and

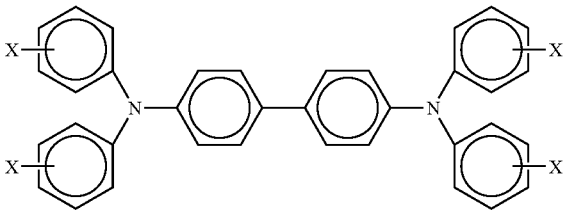

wherein X is selected from the group consisting of alkyl, alkoxy, aryl, and halogen; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of, or at least one of the CTLs comprises

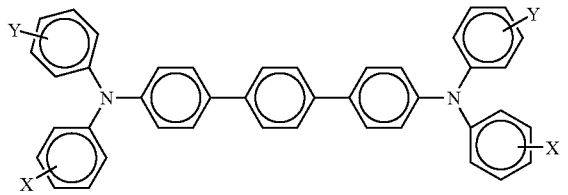

wherein X and Y are independently alkyl, alkoxy, aryl, a halogen, or mixtures thereof; an imaging member wherein alkyl and alkoxy contains from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member, developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the CTL; a member wherein the CTL is situated between the substrate and the photogenerating layer; a member wherein the photogenerating layer is of a thickness of from about 0.1 to about 50 microns; a member wherein the photogenerating component amount is from about 0.5 weight percent to about 20 weight percent, and wherein the photogenerating pigment is optionally dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, or chlorogallium phthalocyanine, and the CTL contains a hole transport of N,N'-diphenyl-N,N-bis(3-methylphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring and fixing the developed electrostatic image to a suitable substrate; photoconductive imaging members comprised of a supporting substrate, a photogenerating layer, a hole transport layer, and a top overcoating layer in contact with the hole transport layer or in embodiments in contact with the photogenerating layer, and in embodiments wherein a plurality of CTLs are selected, such as, for example, from two to about ten, and more specifically, two may be selected; and a photoconductive imaging member comprised of an optional supporting substrate, a photogenerating layer, and a first, second, and third CTL.

The following Examples are being submitted to illustrate embodiments of the present disclosure.

Comparative Example 1

There was prepared a belt photoconductor with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited by applying a wet coating over the blocking layer, using a gravure applicator or an extrusion coater, and which adhesive layer contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) weight average molecular weight of 20,000, available from Mitsubishi Gas Chemical Corporation, and 44.65 grams of tetrahydrofuran (THF) into a 4 ounce glass bottle. To this solution were added 2.4 grams of hydroxygallium phthalocyanine (HOGaPc, Type V) and 300 grams of ⅛ inch (3.2 millimeters) diameter stainless steel shot. This mixture was then placed on a ball mill for 3 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.50 mil. The photogenerating layer was dried at 120° C. for 1 minute in a forced air oven to form a dry photogenerating layer having a thickness of 0.8 micron.

(A) The photogenerating layer was then coated with a single charge transport layer prepared by introducing into an amber glass bottle in a weight ratio of 50/50, N,N'-bis(methylphenyl)-1,1-biphenyl-4,4'-diamine (TBD) and poly(4,4'-isopropylidene diphenyl)carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 29 microns. During this coating process, the humidity was equal to or less than 30 percent, for example 25 percent.

(B) In another embodiment, the resulting photogenerating layer was then coated with a dual charge transport layer. The first charge transport layer was prepared by introducing into an amber glass bottle in a weight ratio of 50/50, N,N'-bis(methylphenyl)-1,1-biphenyl-4,4'-diamine (TBD) and poly(4,4'-isopropylidene diphenyl)carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 14.5 microns. During this coating process, the humidity was equal to or less than 30 percent, for example 25 percent.

The above first pass charge transport layer (CTL) was then overcoated with a second top charge transport layer in a second pass. The charge transport layer solution of the top layer was prepared by introducing into an amber glass bottle in a weight ratio of 0.35:0.65 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the bottom layer of the charge transport layer to form a coating that upon drying (120° C. for 1 minute) had a thickness of 14.5 microns. During this coating process, the humidity was equal to or less than 15 percent. The total two-layer CTL thickness was 29 microns.

Comparative Example 2

A photoconductor was prepared by repeating the process of Comparative Example 1 (A) except that the CTL coating dispersion was prepared by adding polytetrafluoroethylene (PTFE) MP-1100 (E.I. DuPont) into the CTL coating solution of Comparative Example 1 (A), and milling with 2 millimeter stainless shots at 200 rpm for 20 hours, resulting in an CTL coating dispersion formulation of N,N'-diphenyl-N,N'-bis(3-methylphenyl)-1,1'-biphenyl-4,4'-diamine/MAKROLON® 5705/PTFE MP-1100 ratio of 45.5/45.5/9 in methylene chloride with 15 weight percent of solids. This dispersion was filtered, and then applied on the photogenerating layer to form the charge transport layer coating that upon drying (120° C. for 1 minute) had a thickness of 29 microns. During this coating process, the humidity was equal to or less than 30 percent, for example 25 percent.

Comparative Example 3

There was prepared a drum photoconductor with an aluminum drum of 30 millimeters in diameter as the substrate. An undercoat layer was prepared and coated on the substrate as follows. A titanium oxide/phenolic resin dispersion was prepared by ball milling 15 grams of titanium dioxide (STR-60N™, Sakai Company), 20 grams of the phenolic resin (VARCUM™ 29159, OxyChem Company, $M_w$ of about 3,600, viscosity of about 200 cps) in 7.5 grams of 1-butanol and 7.5 grams of xylene with 120 grams of 1 millimeter diameter sized $ZrO_2$ beads for 5 days. Separately, a slurry of $SiO_2$ and a phenolic resin were prepared by adding 10 grams of $SiO_2$ (P100, Esprit) and 3 grams of the above phenolic resin into 19.5 grams of 1-butanol and 19.5 grams of xylene. The resulting titanium dioxide dispersion was then filtered with a 20 micrometer pore size Nylon cloth, and then the filtrate was measured with a Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM™ dispersion. Additional solvents of 5 grams of 1-butanol, 5 grams of xylene, and 5.4 grams of the above prepared $SiO_2$/VARCUM™ slurry were added to 50 grams of the above resulting titanium dioxide/VARCUM™ dispersion (coating dispersion). Then a 30 millimeter aluminum drum, cleaned with detergent and rinsed with deionized water, was dip coated with the above generated coating dispersion, and subsequently dried at 145° C. for 45 minutes, which resulted in an undercoat layer (UCL) deposited on the aluminum, comprised of $TiO_2$/$SiO_2$/VARCUM™ with a weight ratio of about 52/10/38 and a thickness of 4 microns.

A 0.2 micron thick photogenerating layer was subsequently coated on top of the above undercoat layer from a dispersion of Type B chlorogallium phthalocyanine (3 grams) and a vinyl chloride/vinyl acetate copolymer, VMCH ($M_n$=27,000, about 86 weight percent of vinyl chloride, about 13 weight percent of vinyl acetate, and about 1 weight percent of maleic acid available from Dow Chemical (2 grams) in 60 grams of xylene and 30 grams of n-butyl acetate.

Subsequently, a 28 micron thick charge transport layer (CTL) was coated on top of the photogenerating layer from a CTL coating solution prepared from N,N'-diphenyl-N,N-bis (3-methylphenyl)-1,1'-biphenyl-4,4'-diamine (5 grams), and a film forming polymer binder PCZ-400 [poly(4,4'-dihydroxy-diphenyl-1-1-cyclohexane, $M_w$=40,000)], available from Mitsubishi Gas Chemical Company, Ltd., (7.5 grams) dissolved in a solvent mixture of 20 grams of tetrahydrofuran (THF) and 6.7 grams of toluene. The CTL was dried at 120° C. for 40 minutes.

Comparative Example 4

A photoconductor was prepared by repeating the process of Comparative Example 3 except that the CTL coating dispersion was prepared by adding polytetrafluoroethylene (PTFE) POLYFLON® L-2 (Daiken) into the CTL coating solution of Comparative Example 3, and milling with 2 millimeter stainless shots at 200 rpm for 20 hours, resulting in a CTL coating dispersion formulation of mTBD/PCZ-400/PTFE POLYFLON® L-2, ratio of 37.2/55.8/7, in THF/toluene=70/30 (weight/weight) with 24 weight percent of solids. This dispersion was filtered and then applied on the photogenerating layer to form the charge transport layer coating that upon drying (120° C. for 40 minutes) had a thickness of 28 microns.

Example I

A photoconductor was prepared by repeating the process of Comparative Example 1 (A) except that the CTL coating solution was prepared by adding to the above Comparative Example 1 (A) CTL coating solution 5 percent by weight of a polysiloxane-b-polyetherimide block copolymer (ULTEM® STM1500, available from SABIC Innovative Plastics). The resulting solution was applied on the photogenerating layer.

Example II

A photoconductor was prepared by repeating the process of Comparative Example 1 (B) except that the top or second CTL coating solution was prepared by adding to the above Comparative Example 1 (B) CTL coating solution 10 percent by weight of a polysiloxane-b-polyetherimide block copolymer (ULTEM® STM1500, available from SABIC Innovative Plastics). The resulting solution was then applied on the bottom or first charge transport layer.

Example III

A photoconductor is prepared by repeating the process of Comparative Example 1 (B) except that the top or second CTL coating solution is prepared by adding to the above Comparative Example 1 (B) CTL coating solution 5 percent by weight of the polysiloxane-b-polyetherimide block copolymer (ULTEM® STM1600, available from SABIC Innovative Plastics). The resulting solution is then applied on the bottom or first charge transport layer.

Example IV

A photoconductor is prepared by repeating the process of Comparative Example 1 (B) except that the top or second CTL coating solution is prepared by adding to the above Comparative Example 1 (B) CTL coating solution 5 percent by weight of the polysiloxane-b-polyetherimide block copolymer (ULTEM® STM1700, available from SABIC Innovative Plastics). The resulting solution is then applied on the bottom or first charge transport layer.

Example V

A photoconductor was prepared by repeating the process of Comparative Example 3 except that the CTL coating solution was prepared by adding to the above Comparative Example 3 CTL coating solution 5 percent by weight of the polysiloxane-b-polyetherimide block copolymer (ULTEM® STM1500, available from SABIC Innovative Plastics). The resulting solution was applied on the photogenerating layer.

Electrical Property Testing

The above prepared photoconductors of Comparative Examples 1 (A) and 3, Examples I and V were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The photoconductors were tested at surface potentials of 500 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

There was substantially no change in the PIDC curves between the belt photoconductor Comparative Example 1 (A) (without the block copolymer) and Example I (with the block copolymer), and between the drum photoconductor Comparative Example 3 (without the block copolymer) and Example V (with the block copolymer), and where, more specifically, these curves were essentially the same for each of the above photoconductors. Thus, incorporation of the block copolymer into the charge transport layer had no detrimental effects on the electrical performance of these photoconductors.

Wear Testing

The wear tests of the above three drum photoconductors (Comparative Examples 3 and 4, and Example V) were performed using a FX469 (Fuji Xerox) wear fixture. The total thickness of each photoconductor was measured via a Permascope before each wear test was initiated. Then the photoconductors were separately placed into the wear fixture for 100 kilocycles. The total thickness was measured again, and the difference in thickness was used to calculate the photoconductor wear rate (nanometer/kilocycle, nm/kcycle). The smaller the wear rate number, the more wear resistant is the photoconductor. The wear rate data is summarized in Table 1.

TABLE 1

| Photoconductor Device | Wear Rate (nm/kcycle) |
|---|---|
| Comparative Example 3 | 95 |
| Comparative Example 4 (with PTFE in CTL) | 60 |
| Example V (with the block copolymer in CTL) | 64 |

Incorporation of the block copolymer into the CTL (Example V) improved wear resistance of the photoconductor by about 30 percent when compared with the photoconductor of Comparative Example 3 without the block copolymer in the CTL. In addition, the wear resistance of the photoconductor of Example V was comparable to that of the photoconductor Comparative Example 4 with PTFE in the CTL.

Contact Angle Measurements

The advancing contact angles in deionized water on the charge transport layers of Comparative Examples 1 (A) and 2, and Example I photoconductors were measured at ambient temperature (about 23° C.), using the known Contact Angle System OCA (Dataphysics Instruments GmbH, model OCA15). At least ten measurements were performed and their averages and standard deviations are reported in Table 2.

TABLE 2

| | Contact Angle | Friction Coefficient |
|---|---|---|
| Comparative Example 1 (A) | 90 ± 2° | 0.41 ± 0.01 |
| Comparative Example 2 | 80 ± 0° | 0.38 ± 0.01 |
| Example I | 104 ± 1° | 0.33 ± 0.01 |

The contact angle measurements for the charge transport layer of the Example I photoconductor indicated that the incorporation of the polysiloxane-b-polyetherimide block copolymer into the CTL lowered the surface energy (higher contact angle) by about 20 percent, when compared with those of the Comparative Example 1 (A) and Comparative Example 2 (PTFE-doped CTL) photoconductors.

Friction Coefficient Measurements

The coefficients of kinetic friction of the charge transport layers of Comparative Examples 1 (A) and 2, and Example I photoconductors against a polished stainless steel surface were measured by a COF Tester (Model D5095D, Dynisco Polymer Test, Morgantown, Pa.) according to the ASTM D1894-63, procedure A. The tester was facilitated with a 2.5"×2.5", 200 gram weight with rubber on one side, a moving polished stainless steel sled, and a DFGS force gauge (250 grams maximum). The photoconductors were cut into 2.5"×3.5" pieces, and taped onto the 200 gram weight on the rubber side with the surfaces to be tested facing the sled. The coefficient of kinetic friction is the ratio of the kinetic friction force (F) between the surfaces in contact to the normal force: F/N, where F was measured by the gauge and N is the weight (200 grams). The measurements were conducted at a sled speed of 6"/minute and at ambient conditions. Three measurements were performed for each photoconductor tested, and their averages and standard deviations are reported in Table 2.

The friction coefficient measurements indicated a more slippery surface for the disclosed photoconductor CTL (about 20 percent lower friction coefficient) of Example I, when compared with the Comparative Example 1 (A) CTL. The disclosed Example I photoconductor CTL was more slippery (about 10 percent lower friction coefficient) than the PTFE doped CTL of Comparative Example 2. In addition, when compared with the PTFE doped CTL, the disclosed photoconductor CTL is readily and more simply generated since there is no dispersion involved in its preparation and the CTL components of Example I are soluble in the solvent used to permit the achievement of an excellent homogeneous coating solution. In contrast, the preparation of a PTFE doped CTL coating dispersion was very troublesome, and the dispersion was only stable for a short period of time, such as a few weeks.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor consisting essentially of a supporting substrate, a photogenerating layer, and at least one charge transport layer comprised of at least one charge transport component, and wherein said charge transport layer includes a polysiloxane-b-polyetherimide block copolymer.

2. A photoconductor in accordance with claim 1 wherein said polysiloxane-b-polyetherimide block copolymer is prepared by reacting 2,2-bis(2,3-dicarboxyphenoxyphenol)propane dianhydride with metaphenyldiamine and an aminopropyl-terminated $D_{10}$ polydimethylsiloxane.

3. A photoconductor in accordance with claim 1 wherein said polysiloxane-b-polyetherimide block copolymer possesses an $M_w$ of from about 5,000 to about 1,000,000.

4. A photoconductor in accordance with claim 1 wherein said polysiloxane-b-polyetherimide block copolymer possesses an $M_w$ of from about 20,000 to about 200,000.

5. A photoconductor in accordance with claim 1 wherein the weight percent of said polysiloxane in said polysiloxane-b-polyetherimide block copolymer is from about 5 to about 95.

6. A photoconductor in accordance with claim 1 wherein the weight percent of said polysiloxane in said polysiloxane-b-polyetherimide block copolymer is from about 10 to about 50.

7. A photoconductor in accordance with claim 1 wherein said polysiloxane-b-polyetherimide block copolymer is present in an amount of from about 0.05 to about 30 weight percent.

8. A photoconductor in accordance with claim 1 wherein said polysiloxane-b-polyetherimide block copolymer is present in an amount of from about 1 to about 12 weight percent.

9. A photoconductor in accordance with claim 1 wherein said polysiloxane-b-polyetherimide block copolymer is present in an amount of from about 4 to about 10 weight percent.

10. A photoconductor in accordance with claim 1 wherein said charge transport component is comprised of at least one of

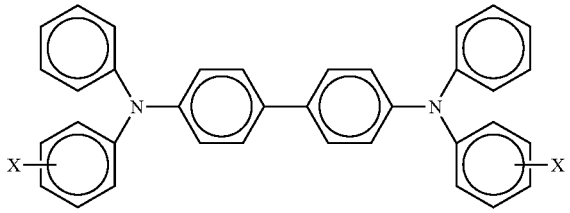

and

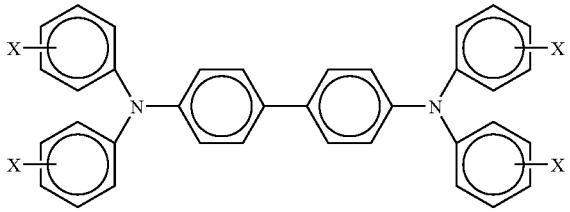

wherein X is selected from the group consisting of at least one of alkyl, alkoxy, aryl, and halogen.

11. A photoconductor in accordance with claim 10 wherein said alkyl and said alkoxy each contains from about 1 to about 12 carbon atoms, and said aryl contains from about 6 to about 36 carbon atoms.

12. A photoconductor in accordance with claim 10 wherein said component is an aryl amine of N,N'-diphenyl-N,N-bis(3-methylphenyl)-1,1'-biphenyl-4,4'-diamine.

13. A photoconductor in accordance with claim 1 wherein said charge transport component is comprised of

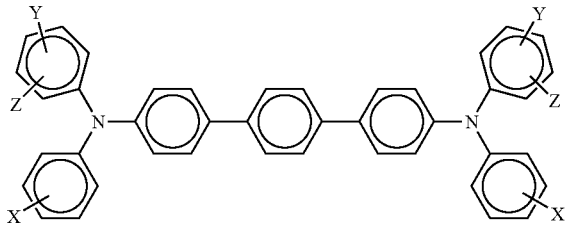

wherein X, Y and Z are independently selected from the group consisting of at least one of alkyl, alkoxy, aryl, and halogen.

14. A photoconductor in accordance with claim 13 wherein said alkyl and said alkoxy each contains from about 1 to about 12 carbon atoms, and said aryl contains from about 6 to about 36 carbon atoms.

15. A photoconductor in accordance with claim 1 wherein said charge transport component is an aryl amine selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and optionally mixtures thereof, and said polysiloxane-b-polyetherimide block copolymer is prepared by reacting 2,2-bis (2,3-dicarboxyphenoxyphenol)propane dianhydride with metaphenyldiamine and an aminopropyl-terminated $D_{10}$ of polydimethylsiloxane.

16. A photoconductor in accordance with claim 1 wherein said member further includes in at least one of said charge transport layers an antioxidant comprised of a hindered phenolic and a hindered amine.

17. A photoconductor in accordance with claim 1 wherein said photogenerating layer is comprised of a photogenerating pigment or photogenerating pigments.

18. A photoconductor in accordance with claim 17 wherein said photogenerating pigment is comprised of at least one of a metal phthalocyanine, metal free phthalocyanine, a perylene, and mixtures thereof.

19. A photoconductor in accordance with claim 1 further including a hole blocking layer, and an adhesive layer, and wherein said substrate is comprised of a conductive material.

20. A photoconductor in accordance with claim 1 wherein said at least one charge transport is from 1 to about 4 layers, and wherein said charge transport component is represented by at least one of

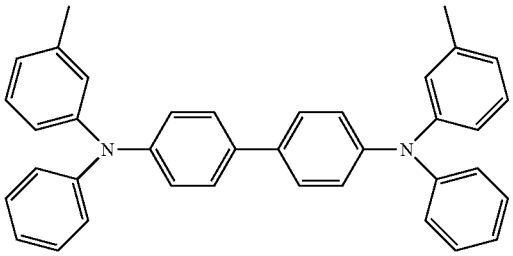

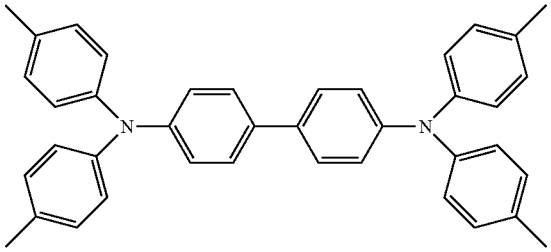

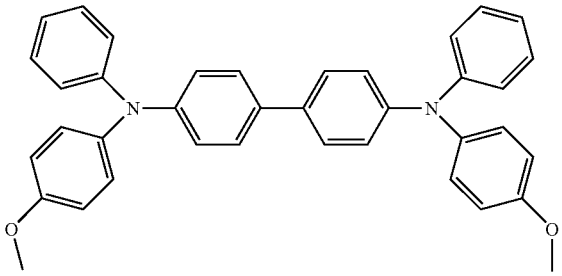

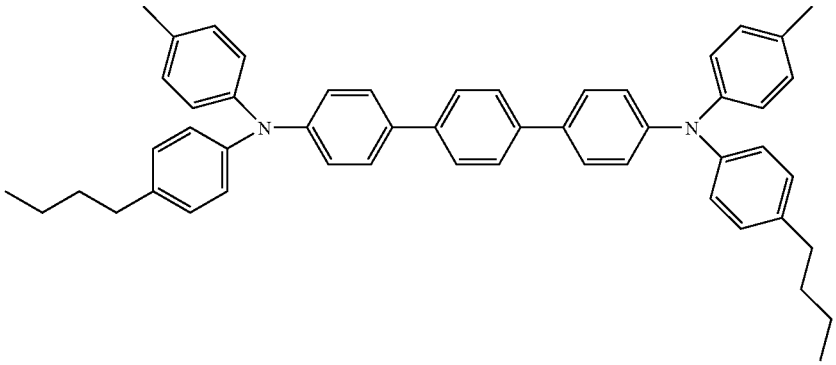

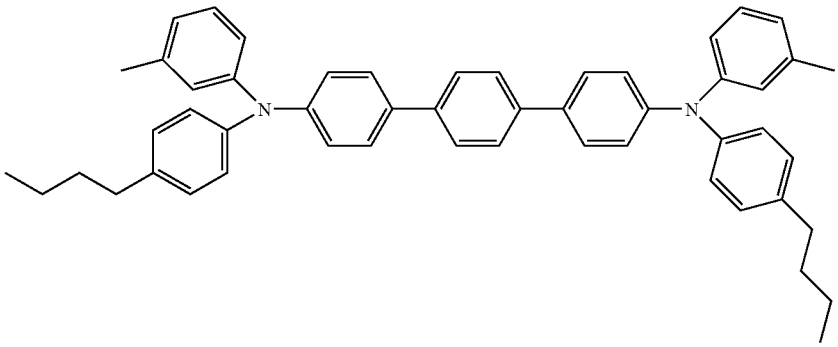

and

-continued

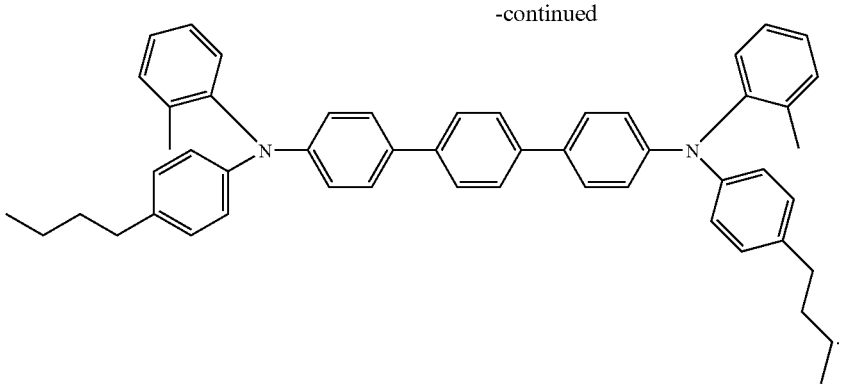

21. A photoconductor in accordance with claim 1 wherein said at least one charge transport layer is comprised of a top charge transport layer and a bottom charge transport layer, and wherein said top charge transport layer is in contact with said bottom charge transport layer and said bottom charge transport layer is in contact with said photogenerating layer, and said polysiloxane-b-polyetherimide block copolymer is prepared by reading 2,2-bis(2,3-dicarboxyphenoxyphenol) propane dianhydride with metaphenyldiamine and an amino-propyl-terminated $D_{10}$ polydimethylsiloxane.

22. A photoconductor comprised in sequence of a supporting substrate, a photogenerating layer thereover, and an additive containing single charge transport layer, and wherein the additive is a polysiloxane-b-polyetherimide block copolymer prepared by reacting 2,2-bis(2,3-dicarboxyphenoxyphenol) propane dianhydride with metaphenyldiamine and an amino-propyl-terminated $D_{10}$ polydimethylsiloxane.

23. A photoconductor in accordance with claim 22 wherein said additive is present in an amount of from about 0.5 to about 20 weight percent.

24. A photoconductor in accordance with claim 22 wherein said additive is present in an amount of from about 2 to about 10 weight percent.

25. A photoconductor in accordance with claim 22 wherein said charge transport layer contains said additive, a charge transport component, and a binder.

26. A photoconductor comprised in sequence of a supporting substrate, a photogenerating layer thereover, and a single hole transport layer, and wherein said hole transport layer is comprised of at least one hole transport compound, a binder resin, and a polysiloxane-b-polyetherimide block copolymer present in an amount of from about 1 to about 12 weight percent, and wherein said hole transport compound is present in an amount of from about 50 to about 75 weight percent.

27. A photoconductor in accordance with claim 26 wherein the polysiloxane-b-polyetherimide block copolymer is present in an amount of from about 1 to about 10 weight percent.

28. A photoconductor in accordance with claim 26 wherein said binder resin is a polycarbonate.

29. A photoconductor in accordance with claim 26 wherein said block copolymer is present in an amount of from about 3 to about 10 weight percent.

* * * * *